US006446784B1

(12) United States Patent
Veldhuizen et al.

(10) Patent No.: US 6,446,784 B1
(45) Date of Patent: Sep. 10, 2002

(54) METHOD AND APPARATUS FOR TURNING EGGS

(75) Inventors: Willem Veldhuizen; Gerrit Hout; Jos Janssen; Hossein Moayeri, all of Barneveld (NL)

(73) Assignee: FPS Food Processing Systems B.V. (NL)

( * ) Notice: Subject to any disclaimer, the term of this patent is extended or adjusted under 35 U.S.C. 154(b) by 12 days.

(21) Appl. No.: 09/706,352

(22) Filed: Nov. 6, 2000

(30) Foreign Application Priority Data

Nov. 5, 1999 (EP) ..... 99203637
Nov. 5, 1999 (EP) ..... 99203638

(51) Int. Cl.[7] ..... B65G 47/244
(52) U.S. Cl. ..... 198/399; 198/394; 198/395
(58) Field of Search ..... 198/394, 395, 198/397.01, 398, 399

(56) References Cited

U.S. PATENT DOCUMENTS 2,643,778 A * 6/1953 Socke ..... 198/394
3,370,692 A * 2/1968 Mosterd ..... 198/394
3,612,245 A * 10/1971 Noguchi ..... 198/34
3,985,223 A * 10/1976 Forcella et al. ..... 198/479
4,366,896 A * 1/1983 Tomosue ..... 198/394
4,645,058 A * 2/1987 Meyn ..... 198/400
4,805,778 A * 2/1989 Nambu ..... 209/938
5,030,001 A * 7/1991 Vande Vis ..... 209/510
5,176,243 A * 1/1993 Temming et al. ..... 198/400
5,238,121 A * 8/1993 Frisbie ..... 209/539
5,605,216 A * 2/1997 Raybon et al. ..... 198/395
5,749,453 A 5/1998 Doornekamp et al.

* cited by examiner

*Primary Examiner*—Douglas Hess
(74) *Attorney, Agent, or Firm*—Larson & Taylor, PLC

(57) ABSTRACT

In a sorting apparatus for, for instance, eggs, an apparatus for turning eggs is arranged. The eggs are located on rollers which are mounted on axes of a roller conveyor. Further provided is a detection device for scanning the direction of orientation of each egg during transport on the roller conveyor, while turning elements are mounted on an endless chain, which turning elements during transport on the roller conveyor pick up the eggs from the roller conveyor, if necessary turn the eggs with the point in a pre-set direction, and subsequently deposit the eggs on a next transporting apparatus. The detection device consists of a device for effecting images of the eggs passing and for electronically processing the images, whereby an orientation signal is formed and a turning signal is delivered to the turning apparatus for turning the eggs in the desired direction.

14 Claims, 3 Drawing Sheets

1
2
2a
3
4
4l
5a
5b
6
7
8
9
A1
A2
B
E
E
E

METHOD AND APPARATUS FOR TURNING EGGS

The present invention relates to an apparatus for turning substantially spherically-symmetrical articles, such as eggs.

In particular, the invention relates to an apparatus for turning eggs, with the eggs located on rollers which are mounted on axes of a roller conveyor, and with a detection device for scanning the direction of orientation of each egg during transport on the roller conveyor, and with turning elements mounted on an endless chain, which turning elements during transport on the roller conveyor pick up the eggs from the roller conveyor, turn the eggs with the point in a pre-set direction, and subsequently deposit the eggs onto a next transporting apparatus.

It is generally known that a uniform orientation of the eggs is required to ensure both the storage life of the eggs and the safe packaging of the eggs. To effect such a uniform orientation, in the past a variety of apparatuses have been devised and implemented.

Such an apparatus is known, for instance, from U.S. Pat. No. 5,749,453, which describes how eggs are supplied to a so-called turning mill. Located on rollers of a roller conveyor, the eggs, directly upstream of the turning mill, reach a saddle-shaped stop element which in all cases pushes the eggs with the big end in the direction of movement of the roller conveyor. Immediately after that, the eggs are picked up by grippers of the turning mill, turned in the desired direction during rotation of the mill, and thereafter laid onto a next roller conveyor for further handling.

The new generation of egg sorting machines is subject to far-reaching requirements regarding hygiene. This makes the use of a smaller model of rollers necessary, thereby enabling the interposition of devices for removing, for instance, leaking eggs.

It is precisely these smaller rollers that make the use of the above-mentioned apparatus unreliable because the eggs, upon being stopped by the stop element, will not always turn in the right direction.

To remedy the above drawback, the apparatus according to the invention is characterized in that the turning elements turn only those eggs which, as indicated by a turning signal delivered by the detection device to the turning apparatus, do not point in the pre-set direction.

In a particular exemplary embodiment, each turning element consists of a rotary element mounted on one of the ends of a rotary shaft, and a gripper suspension frame connected with the other end of the rotary shaft, the shaft being received in a housing having therein a coupling element for coupling or uncoupling the rotary element and the frame, and an actuator for operating the coupling element, the apparatus further comprising a rotation driving element.

What is thus achieved is not only that all eggs have their point pointing in the same direction, but also, in an advantageous manner, a higher processing rate is accomplished, since the mechanical handling as mentioned above can only deal with rates of up to 10,000 eggs per hour.

In a further exemplary embodiment of the apparatus according to the invention, the rotary element consists of a star wheel with four star wheel blades of which the opposite blades are mounted as pairs above each other on the rotary shaft, and upon advancement of the chain the pairs of the star wheel are guided and rotated along curves of a curve path correspondingly arranged above each other.

In this way, a highly uniform and ensured rotation is obtained which prevents accidents and damage to delicate products as eggs are.

The present invention also relates to an apparatus and method for turning substantially spherically-symmetrical articles, such as eggs.

More particularly, the invention relates to an apparatus and method for turning eggs, with the eggs located on rotary rollers mounted on axes of a roller conveyor, and with a detection device for scanning the direction of orientation of each egg during transport on the roller conveyor, and with turning elements mounted on an endless chain, which turning elements during transport on the roller conveyor turn the eggs with the point to the predetermined direction, and subsequently deposit the eggs on a next transporting apparatus.

It is customary to have eggs rotate as soon as they are deposited from supply units such as pallets, boxes or containers, onto rollers of supply rows. Due to the rotary movement which the eggs then follow, the long axes or main axes of the eggs will come to lie substantially parallel to the axes of the rollers of the roller conveyor, thereby preventing skewed or upward orientation of the eggs, and hence an increased risk of damage or breakage. Incidentally, both the shape of the eggs and the shape of the rollers, generally designated as hourglass-shaped, have as a consequence that the points of the eggs will lie in one of the two directions of the axis. Moreover, due to the spinning of the eggs, their centers will be displaced with respect to the centers of the rollers on which they lie.

It is generally known that a uniform orientation of the eggs is required to ensure both the storage life of the eggs and the safe packaging of the eggs. To effect such a uniform orientation, in the past a variety of apparatuses and methods have been devised and implemented.

Such an apparatus is known, for instance, from U.S. Pat. No. 5,749,453, which describes how eggs are supplied to a so-called turning mill. Located on rollers of a roller conveyor, the eggs, directly upstream of the turning mill, reach a saddle-shaped stop element which pushes the eggs with the big end in the direction of movement of the roller conveyor. Immediately after that, the eggs are picked up by grippers of the turning mill, turned in the desired direction during rotation of the mill, and thereafter laid onto a next roller conveyor for further handling.

The new generation of egg sorting machines is subject to far-reaching requirements regarding hygiene. This makes the use of a smaller model of rollers necessary, because this enables the interposition of devices for removing, for instance, leaking eggs.

It is precisely these smaller rollers that make the use of the above-mentioned apparatus unreliable, because the eggs, upon being stopped by the stop element, will not always turn in the right direction.

To remedy the above drawback, the apparatus according to the invention is characterized in that the detection device consists of a device for effecting images of the eggs which pass on the roller conveyor and for electronically processing the images, while an orientation signal is formed which represents for each egg the direction in which the point of the egg points, each signal is compared with a predetermined signal feature associated with a set orientation, and a turning signal is delivered to the turning apparatus for turning the eggs in the desired direction.

What is thus achieved is not only that all eggs have their point pointing in the same direction, but also, in an advantageous manner, a higher processing rate is accomplished, since the mechanical handling as mentioned above can only deal with rates of up to 10,000 eggs per hour.

In a further exemplary embodiment of the apparatus according to the invention, the detection device further comprises for each egg when passing, a light source for illuminating the egg passing on the rollers, and a camera surface, provided parallel to the axes of the roller conveyor, with a surface extending over at least the main axis of an egg, while at least one substantially umbral image of the passing egg is formed.

In a further advantageous exemplary embodiment of the invention, the camera surface is divided into two halves at the center of each passing roller. In this way, a single recording can suffice and use can be made of the off-centre or also the asymmetrical location of, in particular, the centers of each egg on the rollers.

Further, the present invention provides a method characterized by imaging the eggs which pass on the roller conveyor, electronically processing the images obtained upon imaging, whereby an orientation signal is formed which represents for each egg the direction in which the point of the egg points, comparing each orientation signal with a predetermined signal feature associated with a set orientation, and delivering a turning signal for turning the eggs in the desired direction.

More particularly, the invention comprises an exemplary embodiment comprising illuminating each egg passing on the rollers, imaging the egg on a camera surface parallel to the axes of the roller conveyor, with a surface extending over at least the main axis of an egg, while at least one substantially umbral image of the passing egg. is formed.

In a further exemplary embodiment, the linear imaging of the egg takes place parallel to the axes of the roller conveyor, whereby a linear image of at least a part of the egg parallel to the main axis thereof is formed.

In a further advantageous exemplary embodiment of the present invention, the egg is imaged on a camera surface which is divided into two halves at the center of each passing roller.

Thus, in a highly suitable and simple manner, reliable and easily processable information is obtained, which uniformly represents the orientation of the egg.

In a further advantageous exemplary embodiment of the invention, the method is characterized by:

comparing lengths or parts of lengths of each linear image with which an orientation signal is obtained, comparing this orientation signal with the signal feature, and subsequently generating the turning signal.

Further advantages, details and particulars will be elucidated with reference to the accompanying drawing, which shows a schematic elevation of a roller conveyor with eggs located thereon, while passing a detection device according to the present invention.

Further particulars and details will be elucidated with reference to the accompanying drawing, in which FIG. 1 is a general view of a row of a sorting apparatus for eggs, including an apparatus for turning eggs according to the present invention;

In the figures, the same parts are designated by the same reference numerals.

Figure 1:
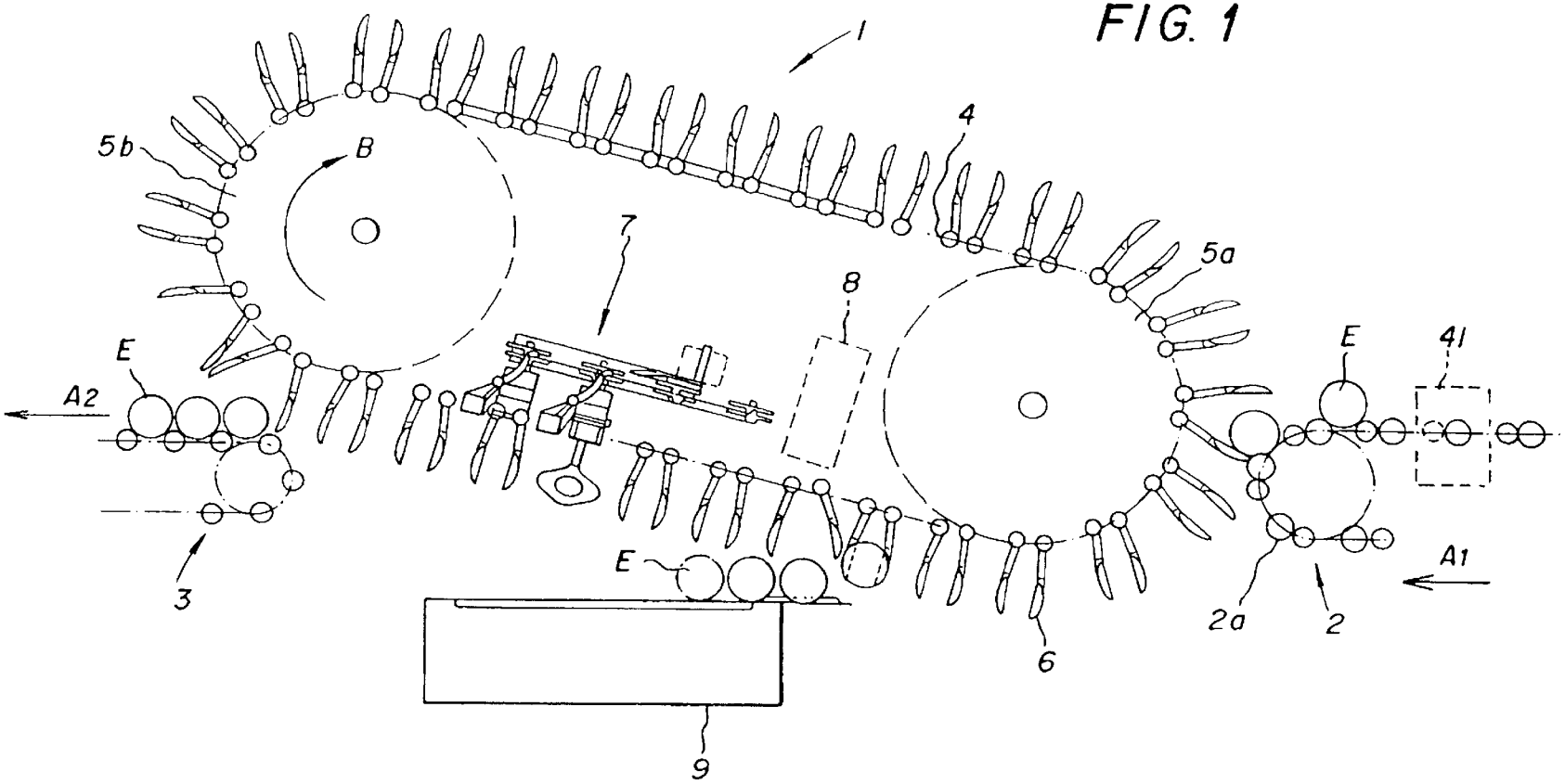

In FIG. 1, turning apparatus 1 forms a part of a sorting machine for eggs E which are supplied in the direction A1 on rollers 2*a* of a generally known roller conveyor 2, are picked up by grippers 6 which are mounted on an endless chain 4, in turn driven by gear wheels 5*a, b*, of which one is driven (or both are driven) by a drive mechanism (not shown) and which rotate in direction B. After the eggs E are turned in the ascending part of the movement, the eggs are released from the grippers onto a next transporting apparatus 3, in this case likewise a roller conveyor. In this figure, it is indicated how during the ascending movement, the eggs first pass an ejection station 8 and thereafter are turned in turning station 7. The eggs ejected in station 8 are collected in a discharge device 9, for instance a discharge conveyor.

Figure 2:
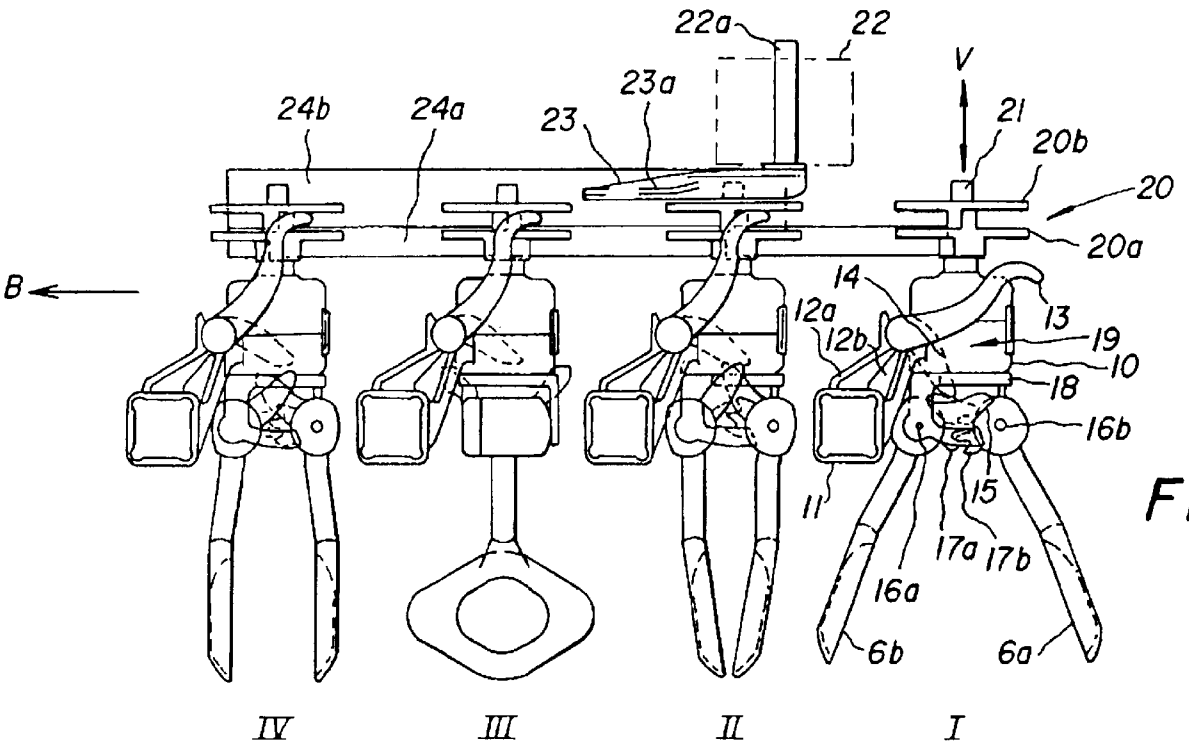
FIG. 2 is a side elevation of a detail of the apparatus according to the invention.

In FIG. 2 a part of the turning apparatus is shown in detail. The turning elements consist of a housing 10 which is mounted through legs 12*a, b* on a cross beam 11. This cross beam 11 extends in a direction transverse to chain 4 (not shown) and carries a number of housings 10, for instance six, which number corresponds to the number of supply rows comprised by this part of the sorting machine. Arrow B again indicates the direction of travel.

The gripper arms 6*a,b* of gripper 6 are held together by a spring, not shown. By means of a handle 13, connected through a shaft (perpendicularly to the plane of the paper) to a driving tooth 14, located in this view on the rear side of housing 10, which driving tooth 14 in turn can rotate a gripper driving tooth 15 connected with one of the gripper arms.

The gripper arms 6*a,b* are each connected with gripper rotation teeth 17*a,b* on gripper rotation pins 16*a,b*. As soon as the handle when passing a cam (not shown in FIG. 1) is pushed down clockwise, this rotation will be transmitted by the above-mentioned teeth and meshing toothings, and the gripper arms 6*a,b* will be moved apart, either to proceed to pick up eggs from roller conveyor 1 (see FIG. 1) or to release eggs in ejection station 8. Analogously, the gripper arms can be closed to engage the eggs for further transportation or after release, for instance on conveyor 2 from FIG. 1.

Figure 3:
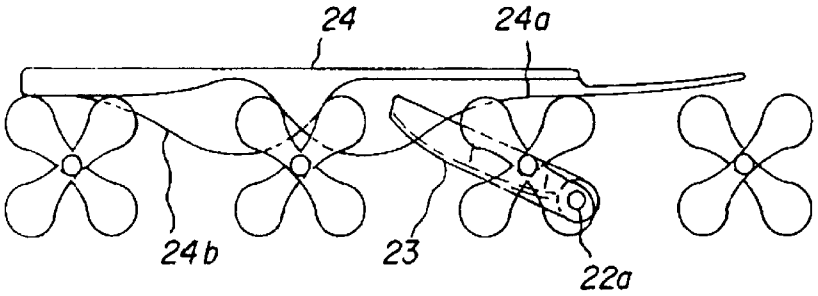
FIG. 3 is a top plan view of a part of the portion of the apparatus shown in FIG. 2.

The gripper arms 6*a,b* are carried in a gripper suspension frame 18 which is rotatably connected with a housing 10. The rotation thereof, as a result of which the eggs are turned, is obtained by rotary shaft 21 connected with the frame. At the upper end of this rotary shaft, a star wheel 20 is mounted. As indicated in FIGS. 2 and 3, the star wheels 20 consist of pairs of star wheel blades 20*a,b* arranged above each other on the rotary shaft. By passing the star wheel blades along curves 24*a,b* of a curve path 24, the shaft is rotated and hence the gripped eggs E are turned.

Since in general not all eggs need to be turned, an actuator 22 is provided which is capable of operating a shaft coupling 19 (not shown) in the housing 10. This shaft coupling can interrupt the rotation of a star wheel and frame mounted on the same shaft. After interruption, the star wheel will rotate when passing the curve path, but the frame will not. In that case, the eggs are not turned. For clarity's sake, it should be mentioned that 'turning' means a turn through 180°. Such shaft couplings are generally known and will not be further elucidated here.

In FIG. 2, actuator 22 is represented schematically. The operation contemplated in this exemplary embodiment comprises downward movement of the star wheel in the direction indicated by arrow V. This movement takes place when the star wheel passes a cam 23 which has been brought into the path of the star wheel by the actuator through rotation of a shaft 22*a*. As a result, the shaft parts of rotary shaft 21 coupled by means of a snap coupling 19 (not shown) are uncoupled. With advantage, this actuator contains an electromagnetic coupling. In particular, a bistable switch is used, whereby the downward movement, through an electric pulse, causes a magnet to toggle, and the return movement is effected mechanically. At I, II, III, and IV, different possibilities and positions of grippers and frame are indicated. Numeral I can represent the engagement of an egg from conveyor 2; II shows a non-rotated frame without egg; III shows a frame rotated through 90°; IV shows a gripper pair which has been fully rotated, or not.

In FIG. 3 there is shown a curve path 24 as provided above each row of passing grippers 6. The curve path 24 comprises a lower curve 24*a* and an upper curve 24*b*. These will correspondingly guide the pairs of star wheel blades 20*a* and 20*b* mounted above each other on the rotary shaft 21.

This guidance at different levels can be clearly seen in FIG. 2, which also makes clear that the star wheels will be rotated both in coupled and in uncoupled condition. For clarity, the upper pair of the star wheel blade pairs is represented in thin lines and the lower pair in thick lines, "upper" and "lower" referring to the relative positions as indicated in FIG. 2

It will be clear to anyone skilled in the art that small modifications or variants fall within the scope of the claims of the present invention. Thus, when using star wheels, many possibilities of curve paths can be used, for instance to obtain well-defined rotational speeds. Further, the rotation of the frame can be entirely electrical or electromagnetic, eliminating the necessity of star wheels.

Figure 4:
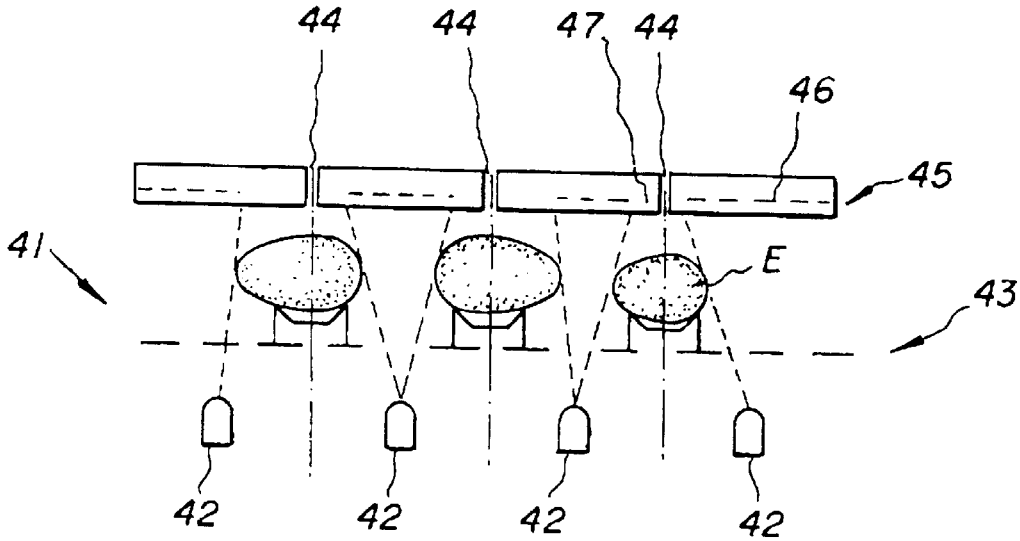
FIG. 4 shows a exemplary embodiment of a detection device according to the invention.

In the exemplary embodiment according of FIG. 4, a detection device 41 comprises light-emitting diodes (LED's) 42, which can be regarded as substantially point-shaped light sources and throw light beams onto passing eggs E which are located on rotary rollers 2*a* of roller conveyor 2, as shown diagrammatically in FIG. 1. The rollers 2*a* are mounted on a shaft or axis 43, indicated by a broken line, of, for instance, a sorting machine 43. Usually, this part of the sorting machine includes six to twelve supply rows, of which three are indicated in cross section in the drawing. The direction of movement of these rollers, on opposite sides connected, in most cases, to an endless chain of a roller conveyor, is directed perpendicularly to the plane of the paper. Arranged above the eggs E are cameras 45. In the present exemplary embodiment, so-called CCD cameras are arranged, such that a linear camera surface 46, 47 extends parallel to the axes 43. The cameras, to be regarded as separate units 43 and forming part of a row of cameras, are positioned such that each unit 43 extends exactly between the centers of adjacent rollers. In the drawing, it is shown how separations 44 between the units 43 are located exactly above these centers.

Upon illumination with the LED's referred to, on the camera surfaces, next to illuminated areas 46, umbral areas 47 will be formed. Given this choice of components, pen-umbral areas will be substantially absent. Clear-cut boundaries make it possible in an advantageous manner to determine and compare the lengths of the umbral areas, for each egg divided over two units in this exemplary embodiment. For these imaging areas (in this case of the eggs) which, as a result of the rolling of the eggs as explained above, are not symmetrically divided, this means that, for instance, the ratio of these lengths always gives a number either greater than 1 or between 0 and 1. This outcome is compared, in the further processing of the camera signal data, with a pre-set signal feature, in order to generate a turning signal on the basis thereof and to deliver it to the turning apparatus. For instance, the turning apparatus will only be energized in the case of outcomes greater than 1.

In the example described, CCD cameras are employed with camera surfaces of 1 by 512 pixels, with pixel surfaces of 120 by 70 $\mu$m each and a relative distance of 125 $\mu$m, with one in four pixels being recorded in the camera terminal circuit. The light of the LED's used had a wavelength of 950 nm.

In an exemplary embodiment of the present invention which is not shown, two or more linear images are made, of each egg. By subsequently determining the relative difference positions both at the point and at the big end, or, stated differently, determining lengths of the differences, it can also be determined where the point or the big end of the egg is located. In this method of determination, the division into halves will not be necessary, since the asymmetrical location does not play a role in this determination anymore.

It will be clear to one skilled in the art that the scope outlined encompasses further possibilities. Thus, illumination will preferably be discontinuous, for instance intermittent, to enable a clear distinction to be made between successive columns of passing eggs. Further, other light sources can be used to likewise obtain sharp umbral boundaries, for instance line-shaped light sources. It will be equally clear that a desired division of a camera surface into halves can be both physical and virtual. In the latter case, a division is set in the control, either electronically or through software.

What is claimed is:

1. An apparatus for orientating eggs comprising:

a roller conveyor on which eggs are transported in a first or a second orientation, which orientations differ from each other in that a certain end of the egg can be directed in a first or a second, opposite direction;

a transporting apparatus downstream from the roller conveyor;

turning elements mounted on an endless chain, which turning elements pick up the eggs from the roller conveyor and subsequently deposit the eggs on said transporting apparatus; and a detection device positioned upstream of the turning elements for detecting the orientation of each egg during transport on the roller conveyor;

wherein the turning elements turn only those eggs which, as indicated by a turning signal supplied by the detection device to the turning elements, are not orientated in a pre-set orientation corresponding to one of said first and second possible orientations.

2. An apparatus according to claim 1, wherein each turning element has a rotary element mounted a rotary shaft, and a gripper suspension frame connected with an end of the rotary shaft, the shaft being received in a housing having therein a coupling element for coupling or uncoupling the rotary element and the frame, and an actuator for operating the coupling element, the apparatus further comprising a rotation driving element.

3. An apparatus according to claim 2, wherein the rotary element includes a star wheel with four star wheel blades of which the opposite blades are mounted as pairs above each other on the rotary shaft, and upon advancement of the chain the pairs of the star wheel are guided and rotated along curves of a curved path correspondingly arranged above each other.

4. An apparatus for orientating eggs, comprising:

a roller conveyor having rotary rollers which are mounted on axes of the roller conveyor on which roller conveyor eggs are transported in a first or a second orientation which orientations differ from each other in that a certain end of the egg can be directed in a first or a second, opposite direction;

a detection device for detecting the orientation of each egg during transport on the roller conveyor;

a transporting apparatus downstream from the roller conveyor; and turning elements mounted on an endless chain, which turning elements each pick up a respective egg from the roller conveyor and subsequently deposit the eggs on said transporting apparatus, wherein the detection device is positioned upstream of said turning elements and includes a device for effecting images of the eggs which pass on said roller conveyor and for electronically processing the images, while an orientation signal is formed which represents for each egg the orientation thereof, and wherein each signal is compared with a predetermined signal associated with a pre-set orientation, and a turning signal is delivered to the turning elements which, dependent upon the turning signal, turn or do not turn the respective egg so that each egg is in said pre-set orientation corresponding to one of said first and second possible orientations.

5. An apparatus according to claim 4, wherein the detection device comprises for each egg, when passing on the roller conveyor, a light source for illuminating the egg, and a camera surface provided parallel to the axes of the roller conveyor, with a surface extending over at least the main axis of an egg, while at least one substantially umbral image of the passing egg is formed.

6. An apparatus according to claim 5, wherein the camera surface is divided into two halves adjacent the center of each roller of the roller conveyor.

7. An apparatus according to claim 5, wherein the camera surface has the shape of a strip which is parallel to the axes of the roller conveyor, while a linear image of at least a part of the egg parallel to the main axis thereof is formed.

8. An apparatus according to claim 7, wherein the camera is a CCD camera.

9. An apparatus according to claim 5, wherein the light source is located, point-shaped, adjacent the centers between the rollers.

10. A method for orientating eggs, comprising:

supplying the eggs on rotary rollers of a roller conveyor on which roller conveyor eggs are transported in a first or a second orientation which orientations differ from each other in that a certain end of the egg can be directed in a first or a second, opposite direction;

during transport on the roller conveyor, detecting the orientation of each egg by imaging the eggs passing on the roller conveyor;

electronically processing the images obtained upon imaging, whereby an orientation signal is formed which represents for each egg the direction in which the certain end of the egg points;

comparing each orientation signal with a predetermined signal associated with a pre-set orientation; and delivering a turning signal for turning the eggs in the desired direction to turning elements which each pick up a respective egg from the roller conveyor and, dependent from the turning signal, turn or do not turn the respective egg so that each egg is in said pre-set orientation and subsequently deposit the eggs on a transporting apparatus downstream from the roller conveyor.

11. A method according to claim 10, including:

illuminating each egg during the detection step when passing on the rollers;

imaging the egg at least once on a camera surface parallel to the axes of the roller conveyor, with a surface extending over at least the main axis of an egg, and forming at least one substantially umbral image of the passing egg.

12. A method according to claim 10, including imaging the egg on a camera surface which is divided into two halves at the center of each passing roller.

13. A method according to claim 1, including linearly imaging the egg parallel to the axes of the roller conveyor, whereby a linear image of at least a part of the egg parallel to the main axis thereof is formed.

14. A method according to claim 13 including:

comparing lengths or parts of lengths of each linear image with which an orientation signal is obtained;

comparing this orientation signal with said predetermined signal; and subsequently generating said turning signal.

* * * * *